US010155223B2

(12) United States Patent
Tuffet et al.

(10) Patent No.: US 10,155,223 B2
(45) Date of Patent: Dec. 18, 2018

(54) CONTAINER FOR RECEIVING AND STORING BIOLOGICAL MATERIAL, ESPECIALLY DNA

(75) Inventors: Sophie Tuffet, Bordeaux (FR); David Georges De Souza, Bordeaux (FR)

(73) Assignee: IMAGENE, Bordeaux (FR)

( * ) Notice: Subject to any disclaimer, the term of this patent is extended or adjusted under 35 U.S.C. 154(b) by 0 days.

(21) Appl. No.: 12/921,964

(22) PCT Filed: Mar. 10, 2009

(86) PCT No.: PCT/FR2009/050393
§ 371 (c)(1),
(2), (4) Date: Sep. 10, 2010

(87) PCT Pub. No.: WO2009/115760
PCT Pub. Date: Sep. 24, 2009

(65) Prior Publication Data

US 2011/0027150 A1 Feb. 3, 2011

(30) Foreign Application Priority Data

Mar. 11, 2008 (FR) ..... 08 51562

(51) Int. Cl.
*B01L 3/00* (2006.01)

(52) U.S. Cl.
CPC ..... *B01L 3/508* (2013.01); *B01L 2200/12* (2013.01); *B01L 2200/141* (2013.01); *B01L 2300/022* (2013.01); *B01L 2300/04* (2013.01); *B01L 2300/042* (2013.01); *B01L 2300/044* (2013.01); *B01L 2300/0832* (2013.01); *B01L 2300/12* (2013.01)

(58) Field of Classification Search
CPC ..... B01L 3/50; B01L 3/508; B01L 3/5082; B01L 3/50825; B01L 2200/141; B01L 2300/04; B01L 2300/021; B01L 2300/042; B01L 2300/044; B01L 2300/0832
USPC ..... 422/547, 549, 550, 555–558, 409, 568; 222/260, 270
See application file for complete search history.

(56) References Cited

U.S. PATENT DOCUMENTS 2,840,826 A * 7/1958 Ebbesen et al. ..... 4/661
3,272,383 A 9/1966 Harvey
(Continued)

FOREIGN PATENT DOCUMENTS

DE 4314137 A1 11/1994
EP 0040014 A1 11/1981
(Continued)

OTHER PUBLICATIONS

Hicks, Jonathan P.; Advances in Tin Cans; Lasers Help in Welding Smooth Seam; Jan. 28, 1987.*
(Continued)

*Primary Examiner* — Brian R Gordon
(74) *Attorney, Agent, or Firm* — Young & Thompson

(57) ABSTRACT

A container designed to store dehydrated biological material under a controlled atmosphere, in particular at ambient temperature, and more particularly DNA, includes an envelope (12) that is made of a gas-tight material. The envelope (12) is made of a material that is metal and cylindrical in shape, sealed at one end, and it includes a stopper (16) that is designed to be connected in an airtight manner to the envelope.

19 Claims, 2 Drawing Sheets

(56) References Cited

U.S. PATENT DOCUMENTS

Figure 1:
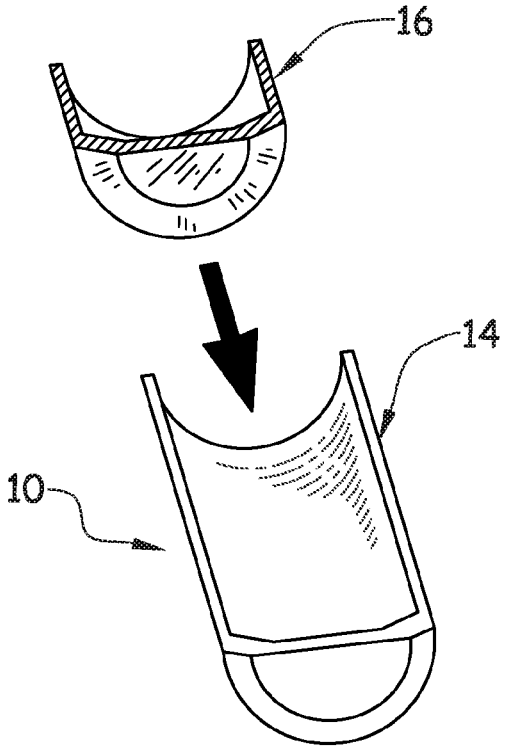

| | | | | |
|---|---|---|---|---|
| 3,355,060 | A | 11/1967 | Reynolds et al. | |
| 4,066,646 | A * | 1/1978 | LeBlanc et al. | 422/550 |
| 4,080,168 | A * | 3/1978 | Abu-Samra et al. | 436/175 |
| 4,402,911 | A * | 9/1983 | Walters | 422/550 |
| 4,821,914 | A | 4/1989 | Owen et al. | |
| 5,246,670 | A * | 9/1993 | Haber et al. | 422/547 |
| 5,344,036 | A * | 9/1994 | Stanescu et al. | 215/251 |
| 5,395,006 | A * | 3/1995 | Verma | 220/371 |
| 5,667,755 | A * | 9/1997 | Baum et al. | 422/548 |
| 6,231,815 | B1 * | 5/2001 | Bainczyk et al. | 422/550 |
| 7,067,086 | B2 * | 6/2006 | Huhn et al. | 422/506 |
| 7,874,420 | B2 * | 1/2011 | Coon | 206/219 |
| 8,075,726 | B2 * | 12/2011 | Nakaya et al. | 156/272.8 |
| 8,241,591 | B2 * | 8/2012 | Ribault et al. | 422/535 |
| 2003/0021920 | A1 * | 1/2003 | Williamson et al. | 428/34.1 |
| 2004/0200736 | A1 * | 10/2004 | Van Heerden et al. | 206/1.5 |
| 2005/0061706 | A1 * | 3/2005 | Reynolds et al. | 206/540 |
| 2007/0017614 | A1 * | 1/2007 | Tramond | 152/152 |
| 2007/0131639 | A1 * | 6/2007 | Nakaya et al. | 215/232 |
| 2009/0120556 | A1 * | 5/2009 | Nakaya et al. | 156/69 |
| 2010/0190215 | A1 * | 7/2010 | Kacian et al. | 435/91.2 |

FOREIGN PATENT DOCUMENTS

| | | | |
|---|---|---|---|
| EP | 0200098 | A2 | 11/1986 |
| EP | 1075515 | B1 | 8/2005 |
| JP | 09174269 | A | 7/1997 |

OTHER PUBLICATIONS

Industriial Laser Systems, LLC; Laser Welding—Design Guideline for Hermetic Sealiing; www.laser-industrial.com/laser_welding.html; 2007.*

French International Search Report, dated Oct. 23, 2009, from corresponding PCT application.

* cited by examiner

CONTAINER FOR RECEIVING AND STORING BIOLOGICAL MATERIAL, ESPECIALLY DNA

BACKGROUND OF THE INVENTION

Field of the Invention

This invention relates to a container that is designed to receive and store biological material, in particular DNA.

Description of the Related Art

DNA has to be stored over very long periods of time both in the field of research and in numerous other fields such as biotechnology, health, the environment, farm produce, identification, justice, and criminology, for example, and in particular for the purpose of the production of biological sample libraries or libraries.

The biological material is of human, animal or plant origin and comprises in particular: tissues; cells; microorganisms such as bacteria, mushrooms, and monocellular algaes; viruses; proteins; and nucleic acids such as DNA and RNA.

The problem is to be able to store this biological material whose degrading elements are the oxygen from the air, water, and light. It is also advisable to protect this biological material from any contaminating element.

The Patent EP 1 075 515 that provides a process for prolonged storage of DNA in an airtight and rustproof metal capsule, consisting of two hemispheres in its embodiment that is being considered, is known.

This DNA is encapsulated in neutral atmosphere and with a very low hygrometric degree so as to make possible its storage at ambient temperature, therefore preventing the use of refrigeration means.

Although these storage means in capsule form are satisfactory, they are hard to industrialize.

It is actually advisable to be easily able to reuse the DNA contained in the capsule, and even to be able to reuse it several times.

In addition, in the biological field, it is necessary to provide an aliquoting stage to produce multiple samples.

SUMMARY OF THE INVENTION

However, a double-hemisphere-type capsule is not the most suitable means, and it is for this reason that this invention proposes a container that is designed to receive biological material and more particularly DNA, which can be sealed in a totally airtight manner, which makes it possible to open said container without degradation of said contents and which makes possible storage and several successive reuses of the reconstituted DNA. In addition, it is necessary to provide an identification of each of the capsules, identification that should be permanent, including after opening said container.

BRIEF DESCRIPTION OF THE DRAWING FIGURES

Figure 2:
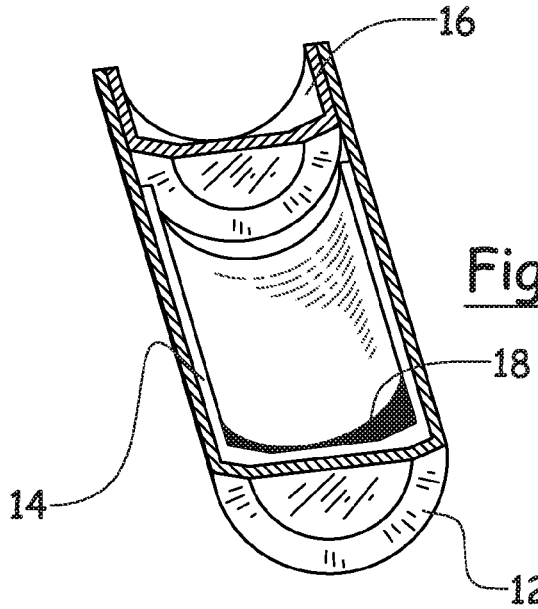

The container according to this invention is now described in detail according to a preferred but non-limiting embodiment, whereby the accompanying drawings allow an illustration of the invention, the different figures representing:

FIG. 1: A perspective view of the container before its use,

FIG. 2: A perspective view of the container that is assembled and in use before welding, FIG. 3: A perspective view of the container that is assembled and in use after welding, FIG. 4: A bottom view of the container after labeling, FIG. 5: A perspective view of the container after being opened for reuse with a seal.

DETAILED DESCRIPTION OF THE INVENTION

FIG. 1 shows a container 10 that is cylindrical in shape and that is 7 mm in diameter and 18 mm in height for a thickness of several tenths of millimeters for the preferred embodiment.

This container consists of an envelope 12, sealed at one end, which is to be made of a gas-tight material that is corrosion-resistant and can be sealed in an airtight manner.

In this case, the material is also to meet an additional constraint which is that of deformability and therefore its malleability for creating said container in a cylindrical shape that is sealed at one end.

Actually, to create the envelope, deep drawing is the most appropriate solution industrially, on the one hand to comply with the necessary dimensional precision as will be explained further and on the other hand to remain within cost parameters that are suitable for large-scale use.

Actually, the grade of stainless steel that is adapted and preferred for the creation of the envelope according to this invention is known commercially under the reference 304L, or, to be more metallurgically correct, under the grade Z2CN18-10.

The container 10 is completed by an insert 14 that is also cylindrical and that comes to be housed with mild friction in the envelope 12.

This insert is advantageously made of glass for its capabilities of storing the biological material and for its stability.

The insert, as shown, has a lower height than that of the envelope.

The container 10 also comprises a stopper 16 that is designed to be forced into the open end of the cylindrical envelope.

This stopper 16 is also cylindrical in shape, whereby its outside diameter is equal, aside from necessary friction, to be forced into the cylindrical envelope.

The stopper is advantageously produced by mechanical deformation of the drawing type such as an envelope and for the same reasons.

The height of this cylindrical stopper is low, on the order of several millimeters, in this case 3 mm, compared to approximately 18 mm of the cylindrical envelope. The thickness of the stopper is also several tenths of millimeters, preferably identical or very close to that of the envelope, in this case 0.25 mm, for reasons of welding parameters, as will be explained further.

The stopper is made in the same material as the envelope to ultimately have a monolithic and single-material container envelope.

It is noted in FIG. 2 that the envelope that has accommodated the stopper leads to a geometry such that the open peripheral edges of the envelope and the stopper are juxtaposed.

Advantageously, the envelope like the stopper comprise a beveled edge or a peripheral groove at the end, resulting from the deformation by drawing but also making possible a perfect introduction of the stopper into the envelope.

According to an improvement of the invention, it is possible to provide a stopper with a slight conicity so as to ensure that it is immobilized in translation after insertion.

FIG. 2 diagrammatically shows the biological material 18, deposited in the insert 14, whereby said biological material is in the dehydrated state.

Advantageously, it is provided to introduce a controlled atmosphere into the container that is sealed and that has to contain and preserve said biological material.

Figure 3:
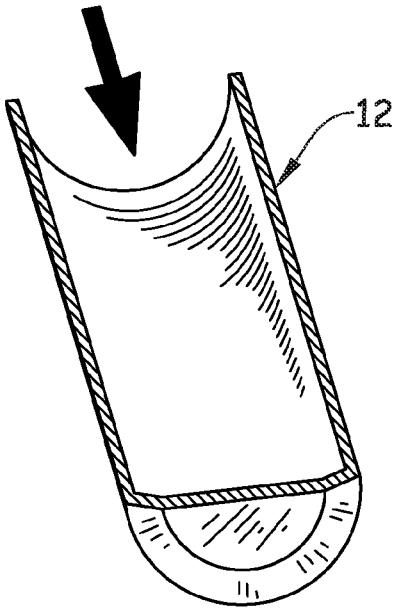
Figure 3:
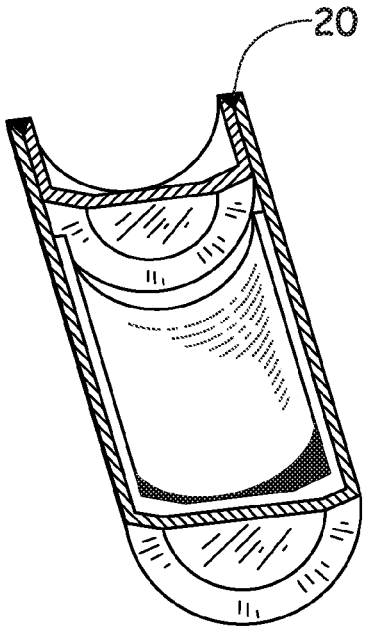

FIG. 3 shows the container that is sealed hermetically and definitively.

A suitable means is a weld 20 of the stopper on the envelope.

It is here that the container according to the invention also shows its advantage. Actually, with the biological material being introduced prior to the creation of the weld and in order to prevent any degradation or any damage to this biological material, it is imperative to limit, and even to avoid, any heating.

Actually, the arrangement according to the invention provides for a laser weld applied peripherally on the two edges of the envelope and the stopper.

Such a weld does not require any filler metal and does not modify the structure of the material that preserves all of its initial properties.

The identical or very close thickness of the two materials is also an advantage for obtaining a homogeneous creation of the weld.

This weld requires a very lower-power laser shot in view of the very small thickness of the walls although no significant elevation of the temperature of the wall and/or in the chamber occurs, and in any case, is totally unable to ensure a modification and/or a degradation of the biological material.

Advantageously, a pulsed YAG-type laser is used although the rise in temperature is negligible, as it has turned out.

It should also be noted that the weld only plays a sealing role and a role in immobilizing the stopper in translation in the envelope without requiring large mechanical connection strengths.

Figure 4:
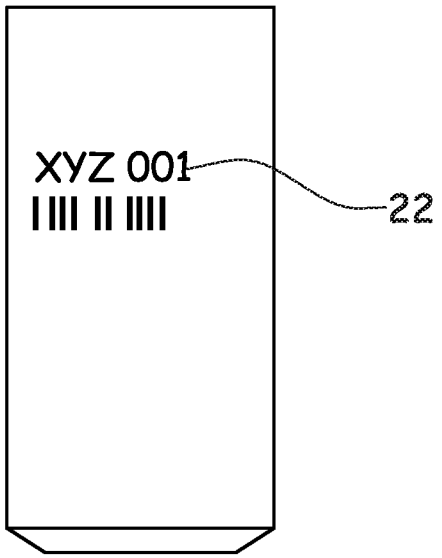

FIG. 4 shows a labeling that is generally created prior to the introduction of biological material to comply with traceability procedures.

In addition, this labeling should be as permanent as the container, which means that an effort should be made to avoid elements that are attached and that can be quickly and easily degraded, such as paint labels, tags, or printing, for example.

The labeling of the container according to this invention is obtained by the creation of a mark 22. This mark itself can contain any type of reference with numbers, letters or bar codes or else matrix codes of the Data Matrix type.

Advantageously, the labeling is produced by changing the surface state of the material under the action of an adapted laser beam. In this case, the material is not incised, but the labeling is nevertheless permanent.

It is noted there too that the labeling by means of a laser beam produces totally negligible energy dissipation on the container, including when the marking is made on the bottom of the container.

Another means is that of attaching an RFID-type tag, i.e., an identification tag that uses hyperfrequencies. In this case, the tag has the role of flattening and mechanically holding an antenna on the wall of the container, whereby this antenna is the active element. The tag does not itself bear an impression, and such a means is considered to be permanent in terms of the invention. Any surface degradation of the tag does not interfere at all with the active identification element.

Figure 5:
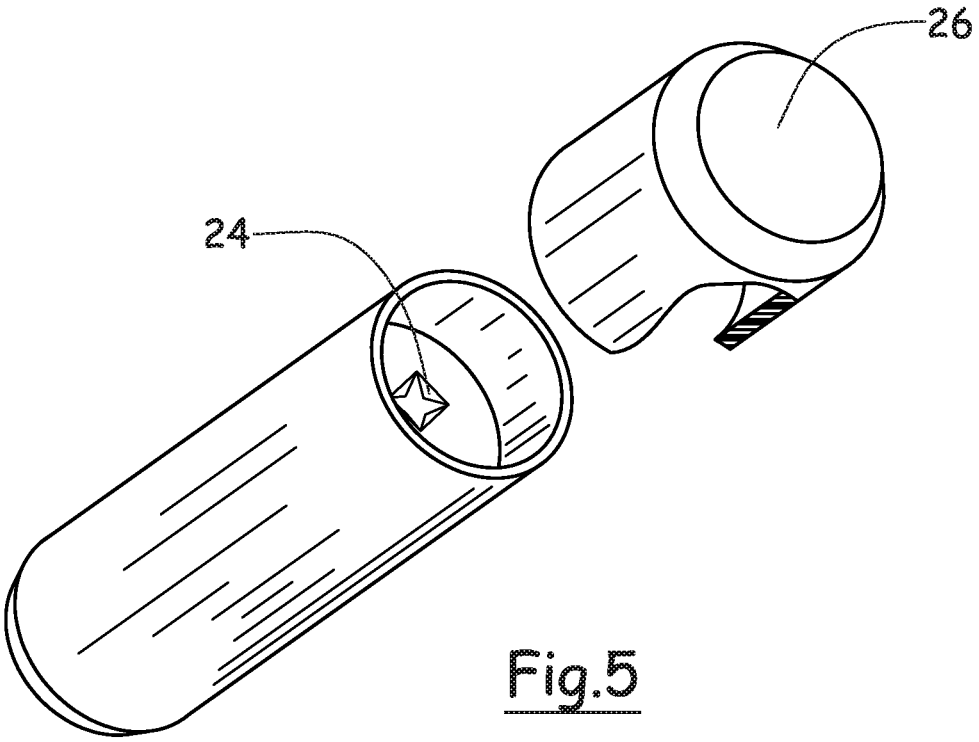

If reference is made to FIG. 5, it is noted that the container makes it possible to use a biological material that is contained and preserved.

Thus, it is provided to accommodate an access window 24, more particularly by perforating cutting using a tool, for example, a diamond-point-shaped punch, at the bottom of the stopper. The diamond point is positioned in the center by marking.

The pressure to be exerted is very low because of the thin thickness of the bottom of the stopper.

It is also noted that the perforation leads to the cutting of several flaps that, under the action of material shape memory, roll, leaving a window with smooth edges, thus facilitating access but primarily aiding the withdrawal of devices designed to be introduced via said window. Actually, the pipettes and other tubes rest on generatrices on the generatrices of the flaps.

Primarily, the biological material cannot be polluted by metal particles since there is no machining but only cutting by drawing the material.

It is also noted that the insert can no longer be degraded mechanically during this operation since it is peripheral.

The labeling also remains entirely accessible and visible since the container does not undergo any mechanical action, only the bottom of the stopper being subjected to the perforation action by the diamond-shaped point.

This window 24 therefore makes it possible to introduce a pipette, a syringe or a similar instrument to add any suitable liquid to put the dehydrated biological material in solution.

This suspended biological material can then be withdrawn completely or partially based on requirements with the same types of instruments.

Of course, the opening is definitive, and the container can no longer allow a very extended storage.

In contrast, the biological material can be used only partially and can require storage over several days, for example for different types of handling.

In this case, the container can also be used to store the biological material that is put back into solution by taking the precaution of placing a seal 26, for example made of neutral elastomer material, on the container.

This seal is either in the shape of a cap as shown in FIG. 5 or in the shape of a truncated cone to be housed in the stopper directly by being held there by radial elastic forces.

It should be noted that the marking remains definitively associated with the container and that the marking of the open container for the purpose of reuse after opening remains possible without inducing any error.

It is also noted that the cylindrical container is also perfectly suitable for manipulations by automatic devices and for positioning on microplate test tube racks that are commonly used in biology, in particular the test tube racks in the known standard SBS, registered trademark.

Likewise, the engraved labeling is extremely visible for an optical reader without producing reading error because of a possible degradation of this labeling, as could be the case with attached tags, for example.

The traceability of the biological material samples can therefore be organized by using the container according to this invention.

The container makes it possible to benefit from all of the advantages that are linked to storage at ambient temperature and in particular to facilitate the exchanges between analytical machines, and between laboratories and to create libraries but in addition to allow the use of automatic devices for the installation of biological material in said container.

These stages comprise at least the operations for dehydration, for introduction of a controlled atmosphere, for sealing by welding, and for labeling.

Even opening by perforation can be done using a device that is equipped with a punch so as to be able to regulate the travel and to ensure perfect guidance.

The automatic analytical devices, including the existing automatic devices, can be equipped with such a device for opening by perforation, avoiding any human intervention.

The insert has been presented as being made of glass, but it is also possible to provide on-site an insert made of ceramic or any other inert material, known or yet to be developed, able to store the biological material.

Likewise, the insert can be replaced in certain applications by balls of inert material with regard to the biological material and loaded in advance with this biological material by adsorption.

The container is provided for storing the biological material at ambient temperature, but for certain biological materials for which it was necessary to ensure storage at a temperature that is lower than or equal to −20° C., it is noted that the storage temperature within the container according to the invention can be brought to positive temperatures of several degrees.

The invention claimed is:

1. A container adapted to store dehydrated biological material under a controlled atmosphere, comprising:

a cylindrical metal envelope made of a gas-tight deformable metal material, the envelope having a sealed end and an annular wall extending a height from the sealed end of the envelope and terminating as an annular peripheral edge;

a cylindrical metal stopper made of a gas-tight deformable metal material, the stopper having a sealed end, an open end, and an annular wall extending a height from the sealed end of the stopper and terminating as an annular peripheral edge at the open end of the stopper, the stopper being housed in the envelope such that the peripheral edges of the stopper and the envelope are coplanar and at the same level; and a laser weld positioned between the peripheral edges of the stopper and the envelope, the laser weld forming an airtight seal between the stopper and the envelope, wherein, the envelope and the stopper are each monolithic, the cylindrical container is sized for positioning on microplate test tube racks according to SBS standards, and the container contains dehydrated biological material under the controlled atmosphere.

2. The container according to claim 1, wherein the container has dimensions of 7 mm in diameter and 18 mm in height, and the container has a thickness of 0.25 mm.

3. The container according to claim 1, wherein the metal is stainless steel Z2CN18-10.

4. The container according to claim 1, wherein an insert is positioned inside the envelope, the insert containing said biological material.

5. The container according to claim 1, wherein the container has perforations.

6. The container according to claim 1, wherein the container further comprises an elastomeric seal that seals the cylindrical envelope after the cylindrical stopper of said container is opened.

7. The container according to claim 1, wherein the container stores the biological material under ambient temperature.

8. The container according to claim 1, wherein the biological material is DNA.

9. The container according to claim 1, wherein the envelope has a glass or ceramic insert containing said biological material.

10. The container according to claim 9, wherein the glass or ceramic insert is a cylindrical insert having a sealed end, an open end and an annular wall extending a height from the sealed end of the insert to the open end of the insert, the sealed end of the insert being proximate to the sealed end of the envelope, and the insert has a lower height than that of the envelope.

11. The container according to claim 1, wherein the envelope peripheral edge of the stopper has a peripheral groove or is beveled at one end, and the peripheral edge of the stopper has a peripheral groove or is beveled at one end to facilitate introduction of the stopper into the envelope.

12. The container according to claim 1, wherein the sealed end of the stopper is conical.

13. The container according to claim 1, wherein the container has a label.

14. The container according to claim 13, wherein the label is a bar code, a data matrix code or an RFID tag.

15. The container according to claim 1, wherein the container has an access window.

16. A container adapted to store dehydrated biological material under a controlled atmosphere, comprising:

a drawn cylindrical metal envelope made of a gas-tight deformable material, the envelope having a sealed end and an annular wall extending a height from the sealed end of the envelope and terminating at an annular peripheral edge;

a drawn cylindrical metal stopper, the stopper having a sealed end, an open end, and an annular wall extending a height from the sealed end of the stopper and terminating as an annular peripheral edge at the open end of the stopper, the stopper being housed in the envelope such that the entire annular wall of the stopper contacts the annular wall of the envelope and the peripheral edges of stopper and envelope are coplanar and at the same level;

a cylindrical insert containing the dehydrated biological material, the insert being housed by friction in the envelope, the insert having a sealed end, an open end, and an annular wall extending a height from the sealed end of the insert to open end of the insert, an annular peripheral edge of an annular wall being at the open end of the insert, the sealed end of the insert being proximate to the sealed end of the envelope, and the open end of the insert being located between the sealed end of the envelope and the annular wall of the stopper;

a laser weld positioned between the peripheral edge of the envelope and the peripheral edge of the stopper, the laser weld forming an airtight connection between the stopper and envelope, wherein the cylindrical envelope and the cylindrical metal stopper are each monolithic, the cylindrical container is sized for positioning on microplate test tube racks according to SBS standards, and the container contains the dehydrated biological material under the controlled atmosphere.

17. A container adapted to store dehydrated biological material or DNA under a controlled atmosphere, comprising:

a gas-tight drawn stainless steel cylindrical envelope, the envelope having a sealed end and an annular wall extending a height from the sealed end and terminating as a peripheral edge;

a glass or ceramic cylindrical insert inside the cylindrical envelope, the insert having a sealed end, an open end and an annular wall extending a height from the sealed end of the insert to the open end of the insert, the sealed end of the insert being proximate to the sealed end of the envelope and the height of the insert being less than the height of the envelope;

a gas-tight drawn cylindrical metal stopper made of a deformable metal material, the stopper having a sealed end, an open end, and an annular wall extending a height from the sealed end of the stopper and terminating as a peripheral edge at the open end of the stopper, and the stopper being housed in the envelope such that the sealed end of the stopper is proximate to the open end of the insert and the peripheral edges of the stopper and the envelope are coplanar and at a same level; and a laser weld positioned between the peripheral edges of the stopper and the envelope, the laser weld forming an airtight connection between the stopper and the envelope, wherein the envelope and the stopper are each monolithic, the cylindrical container is sized for positioning on microplate test tube racks according to SBS standards, and the biological material or DNA is deposited in the insert and contained within the container by the sealed end of the stopper.

18. The container according to claim 17, wherein the sealed end of the stopper comprises perforations forming an access window to provide access to the biological materials.

19. The container according to claim 17, further comprising a cap over the open end of the stopper or a truncated cone housed in the open end of stopper, the cap or the truncated cone providing a reusable seal for the container.

* * * * *